United States Patent [19]

Estam-Goggin

[11] Patent Number: 5,009,624

[45] Date of Patent: Apr. 23, 1991

[54] MAILABLE THREE-DIMENSIONAL GREETING DEVICE

[75] Inventor: Mailiis Estam-Goggin, 26000-L Brigadier Pl., Damascus, Md. 20872

[73] Assignee: Mailiis Estam-Goggin, Damascus, Md.

[21] Appl. No.: 486,890

[22] Filed: Mar. 1, 1990

[51] Int. Cl.[5] ..... A63H 33/00; G09F 1/00

[52] U.S. Cl. ..... 446/71; 446/220; 40/124.1

[58] Field of Search ..... 446/71, 72, 80, 220, 446/223, 226, 147; 40/124.1

[56] References Cited

U.S. PATENT DOCUMENTS

| | | | |
|---|---|---|---|
| 673,776 | 5/1901 | Kavanagh | 446/223 |
| 1,598,828 | 9/1926 | Leatherow | 446/223 |
| 2,635,386 | 4/1953 | Guischard | 446/223 |
| 2,753,658 | 7/1956 | Stickley | 446/223 |
| 4,152,865 | 5/1979 | Ikeda | 446/72 |

*Primary Examiner*—Mickey Yu

[57] ABSTRACT

The combination of a flat piece of card stock and an uninflated balloon permanently attached to each other by a triple-layered strip of sticky tapes, the triple-layered strip of sticky tapes has two sticky outer surfaces, the balloon adhering permanently, while uninflated and while inflated, to one side of the triple-layered strip of sticky tapes and the flat piece of card stock adhering permanently to the opposite side of the triple-layered strip of sticky tapes. The flat piece of card stock has a design printed and/or die-cut on it and the flat piece of card stock has an optional message printed on it. The balloon has a design printed or otherwise manufactured on it, revealing upon its inflation one three-dimensional, design-integrated, coherent visual entity composed of the balloon and the flat piece of card stock which have mutually complementary designs on them, such as an image of facial features printed on the balloon and an image of a graduate cap manufactured on the piece of card stock, the graduation cap having a tassel made of strings attached to a corner of the graduation cap.

20 Claims, 2 Drawing Sheets

MAILABLE THREE-DIMENSIONAL GREETING DEVICE

BACKGROUND OF THE INVENTION

This invention relates to an improved, mailable greeting device which comprises an inflatable balloon having a design printed or otherwise manufactured thereon and a flat piece of card stock having a design printed, die-cut or otherwise inscribed thereon and having an optional message printed or otherwise inscribed thereon, said balloon and said flat piece of card stock being permanently affixed to each other by means of a triple-layered strip of sticky tapes, said strip of sticky tapes permanently and continuously binding together said balloon and said piece of card stock while balloon is flat and uninflated and also during and upon inflation of said balloon, said triple-layered strip of sticky tapes being an integral part of the present invention.

More particularly the purpose of the present invention is to unite in a permanent manner said balloon and said piece of card stock, said balloon and said piece of card stock bearing interrelated designs, said designs complementing one another in such a manner that, upon inflation of said balloon, said greeting device represents one conceptually and visually coherent, whole and three-dimensional image, of which both said balloon and said piece of card stock are integral design components.

Said invention has a further purpose of providing recipient of said greeting device with a visual surprise which becomes apparent as recipient inflates said balloon, thus enlarging an image printed or otherwise manufactured on said balloon. Said greeting device is constructed in such a manner that recipient is provided with an active role in revealing said three-dimensional surprise image conveyed by said greeting device upon inflation of said balloon.

The following patents are mentioned as background prior art, but none of them is pertinent to the present invention:

| U.S. Pat. No. | Date | Inventor |
|---|---|---|
| 4,509,280 | April 9, 1985 | Smith |
| 4,813,902 | March 21, 1989 | Messer |
| **Foreign Pat. No.** | **Date** | **Country** |
| 2,102,099 | July 27, 1972 | West Germany |

Smith discloses a three-dimensional greeting device which comprises a stuffed toy in the shape of an animal, having wing flaps which contain flexible panels which have a message, illustration or other information printed thereon.

Messer discloses a mailable balloon-greeting card combination in which greeting card stock blank has a message printed or otherwise inscribed thereon and which together with tube and clip elements provided therewith can be assembled by recipient to form a triple-paneled stand for the balloon with no mutually associative visual image relationship existing between balloon and triple-paneled stand either when balloon is uninflated or inflated.

The West German patent (Nurenberger-Gummi) discloses a card stock blank having a message inscribed thereon and a balloon, utilizing a slot in said card element into which the base of said balloon is inserted in an invariably upright position, with no mutually associative visual image relationship existing between said balloon and said card elements either when balloon element is uninflated or inflated.

The above mentioned prior patents do not suggest the innovations of the present invention which include a means of permanently uniting a balloon, said balloon having a design printed thereon, and a flat piece of card stock, said piece of card stock having a design printed and/or die-cut thereon and having an optional message printed thereon, in such a manner that said balloon and said piece of card stock remain permanently affixed to each other before, during and after inflation of said balloon. Said permanent physical bond between said balloon and said piece of card stock is provided by a triple-layered strip of sticky tapes. This method of permanently binding said balloon and said flat piece of card stock, which bear mutually complementary designs thereon, makes possible the manufacture of such a greeting device as described in the present invention specification, which upon the inflation of said balloon, as said balloon rests continuously and permanently affixed to said piece of card stock, reveals a surprising, design-integrated and coherent visual image as recipient inflates said balloon, said balloon bearing a design thereon which is enlarged as said balloon is inflated. Such an element of surprise would be lacking if balloon were inflated apart from the greeting card component as is the common procedure with other inventions which have both balloon and greeting card (i.e. card stock) components.

Many greeting devices require the recipient to assemble a balloon component and a greeting card component by means of slots or holes and/or by means of tubes, clips or other cumbersome paraphernelia. A greeting card component of such an invention generally functions primarily as a base member or stand for a balloon component. Even when such a greeting device has miscellaneous decorations and/or verbal messages inscribed onto a balloon and/or onto a greeting card component, such a combination of a balloon component and a greeting card component is apparently not designed in such a way that the balloon component and the greeting card component convey together an integrated and whole design image of the greeting device as a whole, either when the balloon is uninflated or inflated. Such greeting devices which combine a balloon component and a greeting card component in the above described manner also contain limitations in terms of the range of visual images conveyable by the greeting device as a whole because, according to their assembly descriptions, such greeting devices are restriced to having the balloon component in a topmost position in the construction of the greeting device, and to having the greeting card component in the bottommost position, serving as a stand or base for the balloon. A further limitation in terms of possible visual imagery conveyable by greeting devices using the above said means of attachment is encountered when latex balloons are used as part of the greeting device because the stem portion of such a balloon must point down inorder to be attached to the greeting card component as mandated by the means of attachment outlined above. The present invention makes it possible to attach balloon component to a flat piece of card stock (i.e. the greeting card component) with the stem of the latex balloon component, when latex balloon is used, pointing in any one of a nearly unlimited number of possible directions. When a balloon component made of mylar or of some other suitable material is used instead of a latex balloon, in the present invention, the balloon can also be positioned onto the flat piece of card stock at any one of a nearly unlimited number of places on the surface of the balloon component. This versatility of positioning is made possible by said triple-layered strip of sticky tapes.

SUMMARY OF THE INVENTION

This invention includes an inflatable balloon having a design printed or otherwise manufactured thereon, a flat piece of card stock, folded (i.e. having two leaves) or foldless (i.e. having one leaf), said flat piece of card stock having a cover page, said cover page bearing a design printed, die-cut or otherwise manufactured thereon, said flat piece of card stock having also a message page, said message page bearing an optional message printed or otherwise inscribed thereon, and a triple-layered strip of sticky tapes permanently uniting said balloon component and said card stock component while balloon is uninflated and also upon inflation of said balloon component.

Accordingly it is an object of this invention to provide a combination of a balloon and a flat piece of card stock, bearing mutually complementary visual design representations, in a permanently affixed relationship which upon inflation of said balloon component and subsequent enlargement of a printed representation thereon, as said balloon component rests permanently affixed to said card stock component, conveys a unified, coherent and surprising three-dimensional visual image of the greeting device as a whole.

It is another object of the invention to provide the recipient of said greeting device, which combines a balloon and a flat piece of card stock, having mutually complementary designs thereon, with a surprising, three-dimensional visual image, said greeting device requiring no assembly by recipient aside from the inflation of said balloon.

Still a further object of the invention is to provide the recipient of said greeting device with an active role in revealing said surprising three-dimensional visual image, as recipient inflates said balloon while said balloon rests in its permanently attached position against said flat piece of card stock.

It is yet another object of the invention to combine a balloon and a flat piece of card stock in a permanently affixed relationship, attached by means of an innovative triple-layered strip of sticky tapes, which can be mailed flat and which require no accessory items for recipient to assemble.

DESCRIPTION OF THE PREFERRED EMBODIMENT

Figure 1:
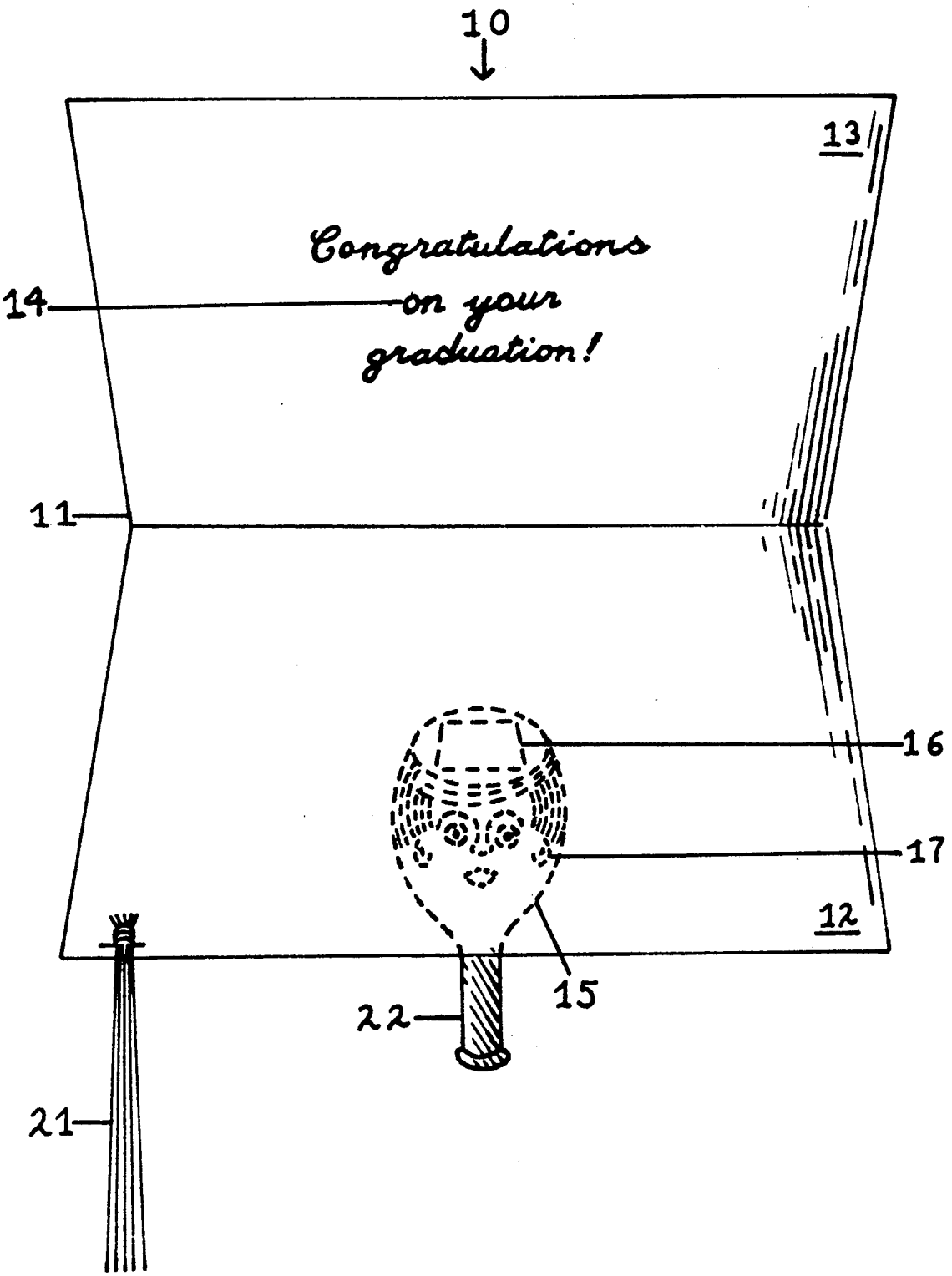
FIG. 1 is a front elevational perspective view showing the combination of a flat piece of card stock, shown in a partially open position and having a cover page and a message page on separate leaves, said message pae having a message printed thereon and said cover page having a tassel stapled thereto, an uninflated balloon having a design printed thereon, and a triple-layered strip of sticky tapes which permanently binds said balloon component and said card stock component into one physically integrated unit and also into one visually integrated design entity upon inflation of said balloon component as shown in FIG. 4.

Referring to the drawings which illustrate a preferred embodiment of the present invention the reference numeral 10 generally refers to the invention which combines a flat card stock component lI, an inflatable balloon component 15 and a triplelayered strip of sticky tapes component 16 into one permanently physically unified greeting device entity 10, said greeting device 10 having a unified and design integrated visual image upon inflation of said balloon component 15.

FIG. 1 of the drawings shows the invention 10 having a flat, folded card stock component 11, said card stock component 11 having a cover page 12 on one leaf and having a message page 13 on its other leaf, said card stock component 11 shown in a partially open position, it being understood that said card stock component 11 may instead consist of a foldless piece of card stock (i.e. having only one leaf, said leaf having a cover page on one side and a message page on its other side) as discreet, it being further understood that said card component 11 which is shown in the preferred embodiment as a flat, generally rectangular shape may instead be made in any other shape such as a circle or a triangle as discreet. Said message page 13 is shown in FIG. 1 and FIG. 4 of the preferred embodiment as containing a message 14 printed thereon, it being understood that said message page may instead be left blank, having no message thereon as discreet.

Figure 4:
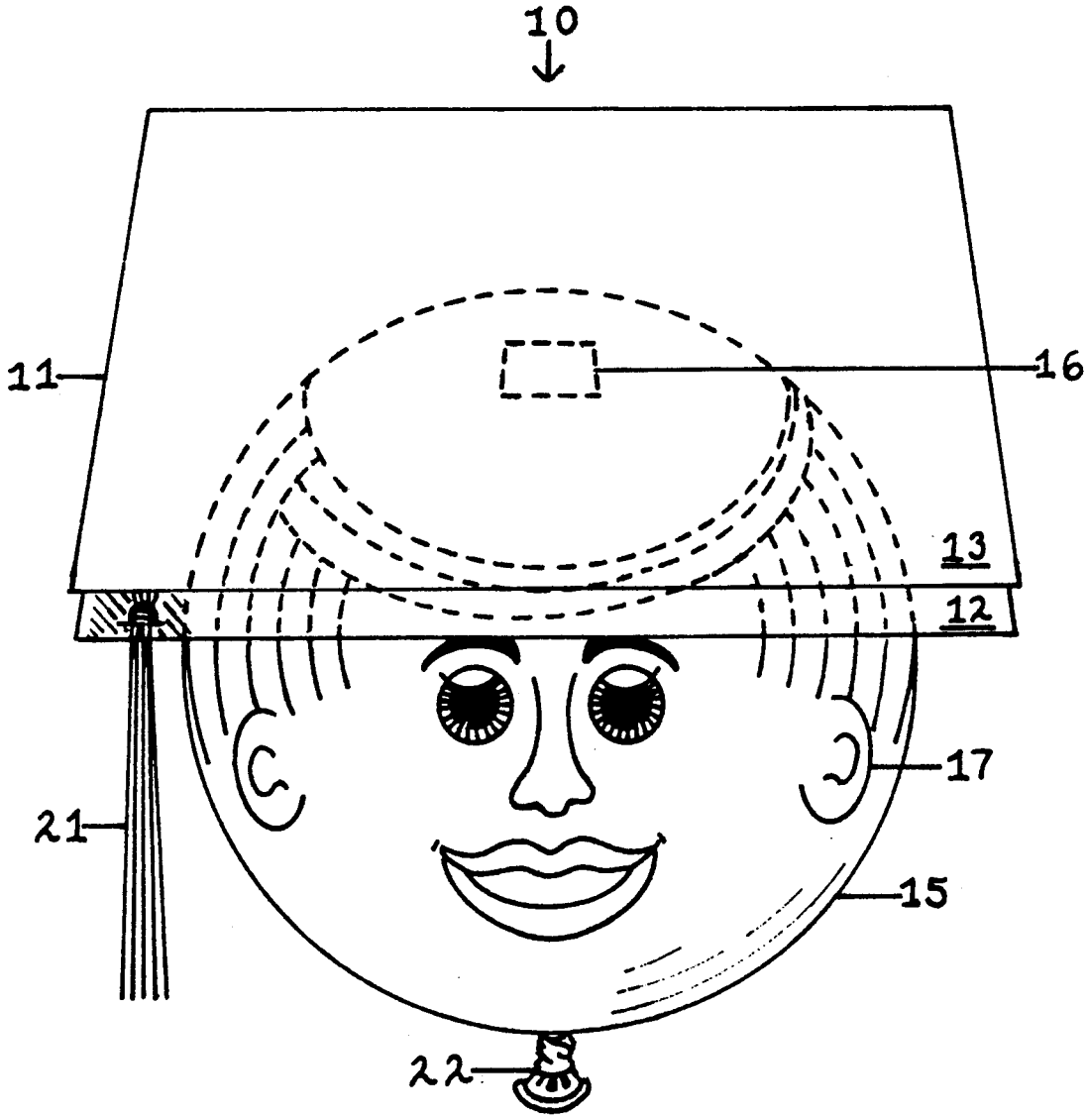
FIG. 4 is a front elevational perspective view showing the combination of said balloon component, shown inflated, said card stock component, shown as being folded and having two leaves which are shown closed, said tassel, attached to said card stock component, and said triple-layered strip of sticky tapes which permanently binds said balloon component and said card stock component into one physically and visually united three-dimensional entity, said balloon and said card stock components thereby conveying together a coherent visual image upon inflation of said balloon component and subsequent enlargement of design representation printed upon said balloon.

FIG. 1 and FIG. 4 show a balloon component 15 which in FIG. 1 is shown flat and uninflated and which in FIG. 4 is shown inflated. Said balloon component 15 is permanently affixed to said cover page 12 by means of said triple-layered strip of sticky tapes component 16, it being understood that when a flat, foldless piece of card stock is used instead of a flat, folded piece of card stock as discreet, said balloon component may be positioned onto either side of flat, foldless card stock component. FIG. 1 and FIG. 4 also show a design 17 printed onto said balloon, said design 17 expanding upon inflation of said balloon component 15 while said balloon component 15 rests permanently affixed against said card stock component 11, said balloon component 15 revealing upon inflation a visually integrated and surprising image of said greeting device 10 as a whole as shown in FIG. 4. Said design 17 printed on said balloon component 15 is shown in the preferred embodiment as being a representation of a face, and said card stock component 11 is shown in the preferred embodiment as being a representation of a graduation cap, it being understood that said balloon component 15 and said card stock component 11 may instead bear other design representations in such mutually complementary combinations that the resulting visual image conveyed upon inflation of said balloon component 15 is of one design-integrated and visually coherent whole as discreet. In FIG. 1 and FIG. 4 of the preferred embodiment, said balloon component 15 is shown as a round shape, it being understood that the balloon component 15 may instead be made in other shapes such as a heart shape or a cone shape to complement any one of a myriad of design possibilities which can be printed onto or die-cut from the flat card stock component 11 as discreet, it being also understood that said balloon component 15 which in the preferred embodiment is shown as being attached to the surface of the flat card stock component 11 at the apex of said balloon component 15, as shown in FIG. 1 and FIG. 4, by means of said triple-layered strip of sticky tapes component 16, may instead be attached to the surface of said card stock component 11 at other positions on said balloon component 15 as discreet.

Figure 2:
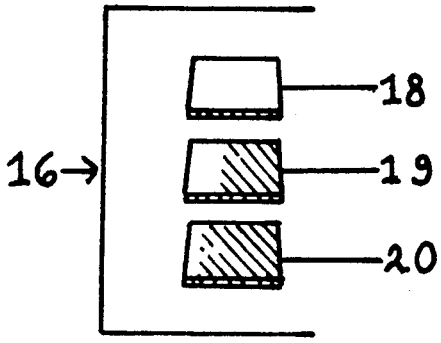
FIG. 2 is an exploded elevational perspective view of three strips of sticky tapes, which when combined together into one strip provide the component of the invention which is used for the purpose of permanently binding together the balloon component and the card stock component of the invention.
Figure 3:
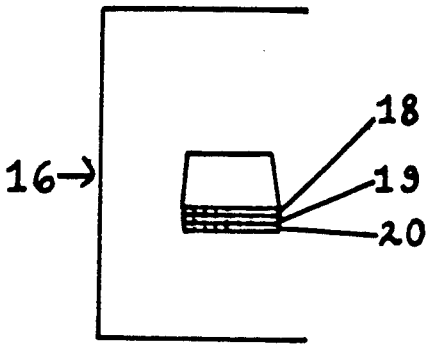
FIG. 3 is an elevational perspective view of the three strips of sticky tape which are shown as being separate from each other in the exploded view in FIG. 2, but which are shown combined together into one triple-layered strip in FIG. 3. Said combined strip of triple-layered sticky tapes is used for the purpose of permanently binding together said balloon component and said card stock component.

The triple-layered strip of sticky tapes 16 which permanently unites said balloon component 15 in both its uninflated and inflated states, as shown in FIG. I and FIG. 4 respectively, is a composite of three layers of sticky tapes, shown in FIG. 2 and FIG. 3. The top layer of tape 18 and the bottom layer of tape 20 are flexible strips of first-aid tape* measuring approximately ⅓ inch by ⅔ inch each, both strips of said first aid tape having one sticky side and one non-sticky side each. The middle layer 19 is a strip of sticky cellophanetype tape measuring approximately ⅓ inch by ⅔ inch and having two sticky sides. Said three layers of strips of sticky tapes 16 are positioned one on top of each other in the order shown in FIG. 2, with the top layer 18 being a strip of said first aid tape, having sticky side facing up and non-sticky side facing down, the bottom layer 20 being also a strip of said first-aid tape, having sticky side facing down and non-sticky side facing up, and the middle layer 19 being a strip of said sticky cellophane-type tape, having sticky sides facing both up and down so that when said three layers of sticky tapes are aligned and pressed one ontop of the other in the given order said layers of sticky tapes form one permanently bonded strip 16 as shown in FIG. 3, having sticky top and sticky bottom surfaces. Said flat piece of card stock 11 is pressed against one side of said triple-layered strip of sticky tapes component 16 and said balloon component 15 is pressed against the opposite side of said triple-layered strip of sticky tapes, this means of connection providing a continuous and permanent bond between said flat card stock component 11 and said balloon component 15 while balloon component 15 is uninflated, as shown in FIG. 1, and also upon inflation of said balloon component as shown in FIG. 4**.

* An example of a suitable first-aid tape is Johnson & Johnson brand first-aid tape.

** An example of a suitable sticky cellophane-type tape is Scotch brand double-stick tape.

As represented in FIG. 4 of the preferred embodiment, the balloon component 15, which in the preferred embodiment is made of latex rubber, may have stem 22 tied in a knot upon inflation to keep air from escaping from the body of said balloon component, but this is not an essential consideration of the present invention, it being also understood that if an alternative material such as mylar is used for the balloon component 15 instead of latex rubber, the open portion of the balloon component may be plugged or otherwise sealed after inflation of said balloon component, without this altering the spirit of the invention as put forth herein. It is not essential for air to be permanently maintained inside of said balloon component 15 after its inflation in order for said greeting device 10 to achieve the afore mentioned objectives of the present invention.

FIG. 1 and FIG. 4 of the preferred embodiment show a tassel element 21, made of strings which are bound at the top and stapled to said flat card stock component 11, it being understood that said tassel element 21 is an optional design addition to said greeting device 10 and that miscellaneous other attachments to the greeting device may be used for added visual effect when appropriate, it being also understood that such attachments are incidental, and are not essential parts of the present invention.

The disclosed details are exemplary only and are not to be construed as limitations on the present invention except as those details may be included in the following claims.

I claim:

1. The combination of a flat piece of card stock, a flat, inflatable balloon and a triple-layered strip of sticky tapes, said strip of triple-layered sticky tapes permanently uniting said flat piece of card stock and said inflatable balloon both while said balloon is uninflated and also upon inflation of said balloon, into one physically intergrated greeting device unit.

2. The invention according to claim 1, wherein said triplelayered strip of sticky tapes is a composite of one strip of cellophane-type tape, measuring approximately one third of an inch by two thirds of an inch and having an adhesive coating on both sides, and two strips of supple and flexible first-aid tape, said strips of first-aid tape each measuring approximately one third of an inch by two thirds of an inch and each strip of said first-aid tape having an adhesive coating on one side only, said strips of first-aid tape being aligned one atop and one underneath said strip of cellophane-type tape, said strips of first-aid tape having said non-adhesive surfaces pressed, and thereby permanently bound to, said cellophane-type tape, said three strips of sticky tapes thereby comprising one inseparable strip of sticky tapes, having two supple and flexible sticky outer surfaces onto which said balloon is adhered on one side and onto which said piece of card stock is adhered on the opposite side, said triple-layered strip of sticky tapes thereby holding said balloon and said piece of card stock in a permanently affixed relationship while said balloon is uninflated and also upon inflation of said balloon.

3. The invention according to claim 1, wherein said flat, inflatable balloon and said flat piece of card stock each bear such mutually complementary design images thereon that upon inflation of said balloon, as said balloon rests continuously and permanently united against said flat piece of card stock, said greeting device conveys one integrated, visually coherent, three-dimensional image as a whole, said image conveyed by said greeting device therefore being a composite of mutually enhancing design images borne upon said balloon and borne upon said flat piece of card stock which together comprise a visually meaningful whole upon inflation of said balloon.

4. The invention according to claim 1, wherein said flat generally rectangular piece of card stock is folded, said piece of card stock therefore having two leaves, one leaf comprising a message page of said greeting device and the other leaf comprising a cover page of said greeting device, said cover page having a design die-cut or printed or otherwise manufactured thereon such as complements and enhances the visual image which is conveyed by balloon component of said greeting device, said design borne upon said piece of card stock being an integral part of the visual design of said greeting device as a whole.

5. The invention according to claim 1, wherein said flat piece of card stock is foldless, said piece of card stock therefore having only one leaf, said single leaf of card stock having a message page on one side and having a cover page on the opposite side, said cover page having a design die-cut or printed or otherwise manufactured thereon such as complements and enhances the visual image which is conveyed by balloon component of said greeting device.

6. The invention according to claim 1, wherein said balloon has a design printed thereon, said design conveying such a visual representation which upon inflation of said balloon complements and enhances a design imprinted, diecut or otherwise inscribed on said flat piece of card stock, thereby revealing one integrated, visually coherent, threedimensional image of said greeting device as a whole.

7. The invention according to claim 1, wherein said triple-layered strip of sticky tapes is a composite of one strip of semi-rigid and semi-flexible cellophane-type tape having an adhesive coating on both sides and two strips of supple and flexible first-aid tape, said two strips of first-aid tape each having an adhesive coating on one side only, said three components of said triple-layered strip of sticky tapes measuring one third of an inch by two thirds of an inch, or measuring slightly more or slightly less, but each strip being of the same size as each of the other said two strips, said strips of first-aid tape being aligned one atop of and one underneath said strip of cellophane-type tape, said strips of first-aid tape each having said non-adhesive surfaces pressed, and thereby bound to, said strip of cellophane-type tape, said three strips of sticky tapes thereby comprising one inseparable strip of sticky tapes, having two sticky outer surfaces onto which said balloon is adhered on one side and onto which said flat piece of card stock is adhered on the opposite side of said triple-layered strip of sticky tapes.

8. The invention according to claim 1, wherein said flat piece of card stock and said inflatable balloon are combined in such a manner, by means of said triple-layered strip of sticky tapes, that said card stock component forms an integral, unremovable part of said greeting device and said balloon component also forms an integral, unremovable part of said greeting device, said components forming in effect, one physically melded greeting device unit.

9. The invention according to claim 1, wherein said flat piece of card stock and said inflatable balloon become essentially one integrated and inseparable physical entity by means of said strip of triple-layered sticky tapes, which unites said balloon and said piece of card stock into one physically and visually coherent entity.

10. The invention according to claim 1, wherein said flat piece of card stock and said balloon bear interrelated images die-cut or otherwise inscribed thereon, said greeting device acquiring, upon inflation of said balloon, a three-dimensional aspect by virtue of sticky tapes and by virtue of said designintegrated relationship between said card stock component and said balloon component, wherein said balloon component is dependent upon said card stock component and said card stock component is dependent upon said balloon component in order for the successful conveying of said integrated, three-dimensional image of said greeting device as a unit.

11. The invention according to claim 1, wherein said flat piece of card stock is folded, said flat piece of card stock therefore having two leaves, one leaf having a message page borne on the inner surface of said folded piece of card stock and the other leaf having a cover page borne on the outer surface of said folded piece of card stock, said greeting device also having said balloon attached by means of said triple-layered strip of sticky tapes approximately to the middle of said cover page, said greeting device having also a tassel element made of strings attached to said message page within approximately ⅓" from the tip of one corner of said generally rectangular piece of card stock.

12. The invention according to claim 1, wherein said piece of card stock is generally rectangular in shape.

13. The invention according to claim 1, wherein said piece of card stock is rectangular in shape.

14. The invention according to claim 1, wherein said piece of card stock bears a tassel element attached to one corner of said piece of card stock at approximately ⅓" from the tip of said corner.

15. The invention according to claim 1, wherein said piece of card stock is folded, said piece of card stock having a tassel element, made of strips, attached to the inner surface of said piece of folded card stock, at approximately ⅓" from the tip of one corner of said piece of card stock.

16. The invention according to claim 1, wherein said piece of card stock is folded.

17. The invention according to claim 1, wherein said piece of card stock has a tassel attached thereto.

18. The invention according to claim 1, wherein said balloon is attached to the center of said piece of card stock.

19. The invention according to claim 1, wherein said piece of card stock is folded, said balloon is attached to the approximate center of the outer surface of one leaf of said piece of card stock.

20. The invention according to claim 1, wherein said triple-layered strip of sticky tapes is a composite of 3 layers of tapes, said layers being equal to one another in length and width, said layers being adhered, by means of adhesive borne on the surfaces of the tapes, directly one on top of the other, said middle-layer of tape being a semi-rigid, semi-flexible strip of cellophane-type tape, having 2 adhesive coated surfaces, said middle layer of tape being sandwich between two layers of supple and flexible first-aid type tapes, each having one adhesive coated surface faceing outward from said composite strip of tapes, said composite strip of tapes having said piece of card stock adhered permanently to said adhesive coated surface on one side of said composite strip, said composite strip having said balloon adhered to said adhesive coated surface on the opposite side of said composite strip, said outer layer of said composite strip attached to said balloon contracting and expanding upon inflations and deflations of said balloon, said outer layer of said composite strip being also permanently attached to said middle layer of tape, said middle layer of tape being permanently attached to said outer layer of tape opposite said balloon element, said outer layer of tape opposite said balloon element being attached to said flat piece of card stock, throughout numerous inflations and deflations of said balloon.

* * * * *